US005900314A

United States Patent [19]

Peruffo et al.

[11] Patent Number: 5,900,314

[45] Date of Patent: May 4, 1999

[54] STRINGS FOR MUSICAL INSTRUMENTS MADE FROM POLYBUTYLENE TEREPHTHALATE

[76] Inventors: Mimmo Peruffo, Via Costantini, 16, Vicenza, Italy; Gianfranco Lovato, Viale Fiume, 59, Vicenza, Italy

[21] Appl. No.: 09/162,868

[22] Filed: Sep. 29, 1998

[30] Foreign Application Priority Data

Oct. 1, 1997 [IT] Italy ..... VI97A0170

[51] Int. Cl.[6] ..... D02G 3/00; G10C 3/08

[52] U.S. Cl. ..... 428/364; 528/302; 428/370; 428/373; 84/197; 84/198; 84/199; 84/455

[58] Field of Search ..... 528/302; 428/364, 428/370, 373; 84/197, 198, 199, 455

[56] References Cited

U.S. PATENT DOCUMENTS 5,338,579 8/1994 Ogawa et al. ..... 427/539

*Primary Examiner*—Samuel A. Acquah
*Attorney, Agent, or Firm*—Bucknam and Archer

[57] ABSTRACT

The plastic material called PBT (Polybutylene terephthalate) in polymeric chains in the form of continuous monofilaments or multifilaments is used for making the strings of plucked and bowed musical instruments.

3 Claims, No Drawings

STRINGS FOR MUSICAL INSTRUMENTS MADE FROM POLYBUTYLENE TEREPHTHALATE

FIELD OF THE INVENTION

This invention relates to the use of a particular thermoplastic product in itself well known (Polybutylene terephthalate) in a pure state or in combination with other compatible thermoplastics, pigments or load agents, in making of strings for musical instruments. The fundamental characteristics required in a synthetic material that can be extruded under heat for making musical strings are principally the following:

1) high breakage load, to allow the string to arrive at the required tuning without premature breaking;
2) ease of extrusion as a monofilament once fusion temperature is reached;
3) low absorption of external humidity;
4) high elasticity, guaranteeing optimal acoustical performance.

Among the various thermoplastic material that can be extruded, the polyamides (generally know by the trade name "nylon") have long satisfied the above conditions and have, hence, be commonly used to make musical strings. Those particular suited to this purpose are the "varieties" known as PA10, PA6-12 (commercially known by Du Pont brand name "Tynex") and PA12.

Compared to the polyamides suited to a general use, such as PA6 and PA6-6, these "varieties" present a lower absorption of atmospheric humidity. The amount of humidity absorbed by a polyamide is a decisive factor in its adoption for musical use since it affects the string in two distinct ways:

1) an increase in absorbed humidity means a drastic reduction in the material's elasticity, thus greatly compromising the acoustical performance of the string;
2) the material's sensitivity to hygrometric variations makes for unstable tuning and the need to retune constantly.

The polyamides recommended for making musical strings should have a specific density ranging between 1.02 and 1.09 g/cm$^3$.

Recently PVF (Polyvinyldenchoride), also improperly known as "carbon", has also been used to make musical strings.

The salient characteristic of this extrudable thermoplastic material is its high specific density (about 1.6 g/cm$^3$): higher, therefore, not only than that of the polyamides used for musical strings, but also of that of gut, whose density is about 1.3 g/cm$^3$.

Gut, a natural material of high cost and low durability, has been used for centuries to make musical strings; only relatively recently it has been partly replaced by synthetic materials. The high density of PVF gives a particularly brilliant, "metallic" acoustical performance, one that is hard to reconcile with the aesthetic criteria of tone quality commonly expected in a string. Expectations generally involve a comparison with a gut string, which has a density midway between that of the polyamides and that of PVF.

As for the polyamides, on account their lower density (compared to gut), their upper partials are less rich and their initial transients less prompt and "noisier".

PBT is a partially crystalline, thermoplastic product consisting of saturated polyester derived from polybutylene terephthalate condensed in repetitive units. The basic product has the following formula:

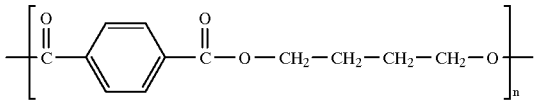

the product is obtained by the polycondensation of terephthalic acid or dimethylterephthalate (DMT) with 1,4-butanediol, in the presence of special catalysts. The terephthalic acid and the 1,4-butanediol are in turn products derived from the petrolchemistry industry: from xylene or acetylene, for example. This product is used principally for making clothing yarns, moulding mechanical elements (containers, nets, car dashboards), as well in the electronics industry and in the making of frames for electronic appliances.

SUMMARY OF THE INVENTION

Surprisingly it has also turned out to be particularly effective In the making of musical strings. PBT is obtained in the form of long polymeric chains permitting the formation of a continuous monofilament of diameters varying from a few millimeters.

The monofilaments can be reciprocally coupled, with or without twisting and in varying number, to form a so-called multifilament. As this material has a specific density similar to that of gut, it can claim to be a new synthetic material with acoustic properties strongly resembling those of the natural material. In some way, this makes it a sort of "synthetic version" of gut. From the practical point of view the product presents the following advantages and features:

1) due to a density lying between the two, its acoustical performance is more brilliant and prompter than that of the polyamides, but not necessarily so "metallic" as PVF;
2) its breakage load is higher than that of gut and practically the same as that of the polyamides;
3) it has a specific density similar to that of gut (1.3 g/cm$^3$);
4) it is easily extruded under heat;
5) in contrast with the case of the polyamides, its high elasticity is unaffected by hygrometric and temperature variations;
6) its absorption of environmental humidity is very low (about 10% only of that presented by the polyamides used in the making of musical strings): this means an unsurpassed stability of tuning;
7) greater durability compared to gut.

Tests carried out have shown that the strings thus made are undoubtedly suited for use on plucked and bowed musical instruments.

What is claimed is:

1. The method of making strings of musical instruments which consists of making a continuous monofilament or multifilaments from condensed polymeric chains of polybutylene terephthalate and making said strings from said monofilament or multifilament.

2. String for bowed and plucked muscial instruments, consisting of a monofilament or multifilament made of condensed polymeric chains of polybutylene terephthalate in a pure state or in combination with other compatible thermoplastic products, pigments or mineral load agents generally up to 30%.

3. The string according to claim 2 wherein polybutylene terephthalate has a density between 1.02 $g/cm^2$ and 1.6 $g/cm^2$.

* * * * *